United States Patent [19]

Schacht

[11] 4,434,609

[45] Mar. 6, 1984

[54] YARN BRAKE AND PROCESS FOR TENSIONING AT LEAST TWO YARNS IN A TEXTILE YARN PROCESSING MACHINE

[75] Inventor: Dieter Schacht, Kempen, Fed. Rep. of Germany

[73] Assignee: Palitex Project Company GmbH, Krefeld, Fed. Rep. of Germany

[21] Appl. No.: 289,807

[22] Filed: Aug. 3, 1981

[30] Foreign Application Priority Data

Jun. 23, 1981 [DE] Fed. Rep. of Germany ..... 3124482

[51] Int. Cl.[3] ..... D01H 7/86; D01H 13/10; B65H 59/06; B65H 59/36

[52] U.S. Cl. ..... 57/58.86; 57/352; 242/47.01; 242/147 R

[58] Field of Search ..... 57/58.52, 58.87, 58.86, 57/58.49, 352–356; 242/147 R, 47.01, 128

[56] References Cited

U.S. PATENT DOCUMENTS

| | | | |
|---|---|---|---|
| 2,718,363 | 9/1955 | Roberts | 57/58.86 X |
| 3,926,381 | 12/1975 | Lawson et al. | 242/47.01 |
| 3,995,786 | 12/1976 | Deniega | 242/147 R X |
| 4,044,962 | 8/1977 | Calamani et al. | 242/47.01 X |

FOREIGN PATENT DOCUMENTS

| | | |
|---|---|---|
| 563593 | 11/1932 | Fed. Rep. of Germany . |
| 1262847 | 3/1968 | Fed. Rep. of Germany . |
| 2427766 | 12/1975 | Fed. Rep. of Germany . |
| 2417552 | 9/1976 | Fed. Rep. of Germany . |

*Primary Examiner*—John Petrakes

*Attorney, Agent, or Firm*—Bell, Seltzer, Park & Gibson

[57] ABSTRACT

A yarn brake and process for applying substantially uniform tension to at least two yarns moving from separate, cross-wound, supply packages of yarn in a textile yarn processing machine, particularly a two-for-one twister, is provided. The yarn brake mechanism includes a member defining an outer, frusto-conical shaped, yarn braking surface tapered in the linear direction of movement of the yarns, and a comb-like, braking, ring member slidably positioned around the braking surface for receiving the moving yarns in braking engagement between the braking surface and the ring member. The ring member has slightly spaced-apart teeth of pliantly elastic, springy material positioned therearound and extending therefrom generally in the linear direction of movement of the yarns. The teeth are inclined with respect to the ring both inwardly into contact with the braking surface and circumferentially in the direction of movement of the yarns so that at least two of the teeth overlap each other along each directrix of the braking surface and apply uniform tension to each of the at least two yarns.

5 Claims, 5 Drawing Figures

YARN BRAKE AND PROCESS FOR TENSIONING AT LEAST TWO YARNS IN A TEXTILE YARN PROCESSING MACHINE

FIELD OF THE INVENTION

This invention relates to a yarn brake and method for applying substantially uniform tension to at least two yarns moving from separate, cross-wound, supply packages of yarn in a textile yarn processing machine, particularly a two-for-one twister.

BACKGROUND AND SUMMARY OF THE INVENTION

In two-for-one twister textile yarn processing machines, each spindle assembly for processing of yarn includes a rotatable rotor mechanism defining a generally vertically and axially extending passageway therethrough for receiving moving yarn for processing, a stationary yarn carrier mounted coaxially around the rotor mechanism and having a generally vertically and axially extending passageway therethrough communicating with the yarn passageway through the rotor mechanism, and at least one supply package of yarn carried by the carrier mechanism. Yarn is withdrawn from the supply package and is passed through the yarn passageways in the carrier mechanism and the rotor mechanism for twisting of the yarn in a well-known manner.

It is often desirable to regulate the tension on the yarn, particularly highly twisted yarn, passing from the supply package to the yarn passageways by a yarn brake mechanism to insure uniformity in the yarn processing. For this purpose, yarn brake rings have been utilized, such as shown in German Pat. No. 563,593, wherein the yarn brake ring, also known as a float ring, is slipped onto a yarn intake tube forming a part of the yarn carrier and cooperates with a generally cylindrical braking surface on such intake tube to receive the yarn between the ring and the braking surface to apply tension to the moving yarn. As the yarn passes between the braking ring and the braking surface, the braking ring is lifted by movement of the yarn and floats up and down the intake tube to apply a frictional braking force to the yarn and thus tension the yarn.

In some yarn processing operations, particularly two-for-one twisting, two or more yarns are often processed or twisted together. In this type of operation, separate cross-wound supply packages of yarn are provided wherein the yarns are simultaneously withdrawn from the supply packages and processed or twisted together. When withdrawing at least two yarns from the separate supply packages, the yarns are usually under different tensions due to nonuniform sizes of the separate supply packages, the nature of cross-winding the separate supply packages, etc.

Accordingly, if a yarn brake ring, of the type known from the above discussed German Pat. No. 563,593 is utilized for tensioning two or more yarns from separate cross-wound supply packages, uniform tension will not be applied to each of the yarns inasmuch as the floating brake ring will move or float upwardly under the influence of one of the yarns to create a gap between it and the braking surface where the other yarn is passing therebetween. This is particularly actue with highly twisted sewing yarns wherein kinks may occur in one of the yarns which is not being uniformly tensioned with other of the yarns, resulting in problems in yarn processing.

Accordingly it is the object of this invention to provide a yarn brake mechanism and process for applying substantially uniform tension to at least two yarns moving from separate cross-wound supply packages of yarn in a textile yarn processing machine, particularly a two-for-one twister textile yarn processing machine.

It has been found by this invention that this object may be accomplished by providing such a yarn brake mechanism and process comprising generally the following.

A member is mounted in the machine and positioned in the linear path of movement of the yarns from the supply packages and defines an outer frusto-conical shaped, yarn braking surface tapered in the linear direction of movement of the yarns. A comb-like, braking, ring member is slidably positioned around the braking surface and dimensioned for receiving the moving yarns in braking engagement between the braking surface and the ring member. The ring member has slightly spaced-apart teeth of pliantly elastic, springy material positioned therearound and extending therefrom generally in the linear direction of movement of the yarns. The teeth are inclined with respect to the ring both inwardly into contact with the braking surface and circumferentially in the circumferential direction of the movement of the yarns as they are unwound from the yarn packages, so that at least two of the teeth overlap each other along each directrix of the braking surface. Means are provided for limiting the sliding movement of the braking ring member along the braking surface in the linear direction of movement of the yarns.

Each of the yarns is frictionally engaged by the ring member and braking surface and by at least two or more of the teeth extending from the ring member regardless of the position of the individual yarns or the position of the ring member on the braking surface, so that each of the yarns are substantially uniformly tensioned regardless of the individual tension on the yarns as they are withdrawn from the separate supply packages.

Although comb-like, braking, ring members have been used for yarn tensioning in knitting, hosiery or other fabric producing machines, such ring members have not been utilized in yarn processing machines, particularly two-for-one twisters, for substantially uniformly tensioning two or more yarns being withdrawn from separate cross-wound yarn supply packages for processing in a textile yarn processing machine, particularly a two-for-one twister. For example, German Patent Publication Nos. AS 1 262 847, OS 24 27 766 and AS 24 17 552, as well as the magazine entitled "textil praxis International" of August 1976 at page 863 and a brochure published by AB IRO of Sweden, disclose brake rings of the type having bristles or teeth extending therefrom and inclined inwardly thereof for cooperating with a generally cylindrical braking surface for applying tension to a single yarn only from a reserve or storing mechanism feeding the yarn to knitting and hosiery machines.

BRIEF DESCRIPTION OF THE DRAWINGS

Some of the objects and advantages of this invention having been stated, other objects and advantages will become apparent as the description proceeds, when taken in conjunction with the accompanying drawings, in which.

DESCRIPTION OF ILLUSTRATED EMBODIMENTS

Figure 1:
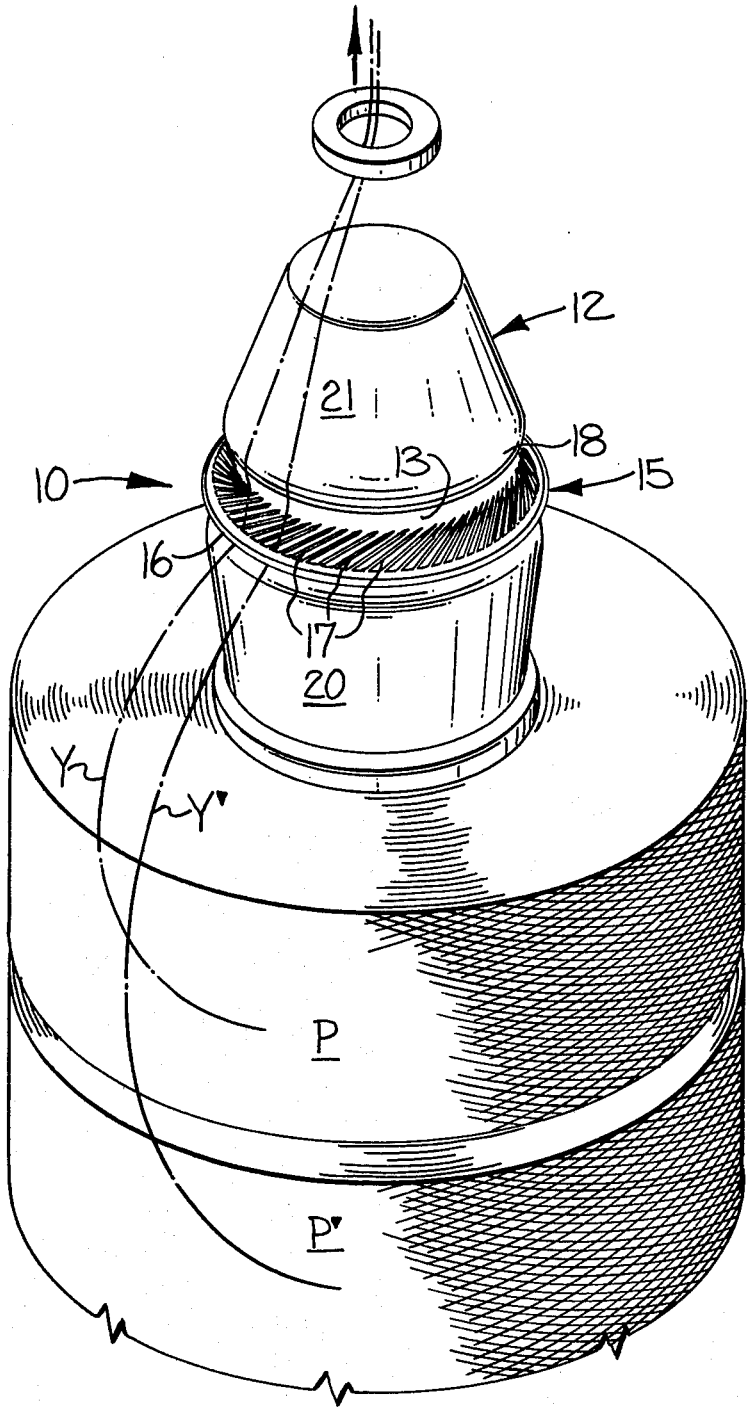
FIG. 1 is a schematic perspective view illustrating the yarn brake mechanism of this invention for tensioning yarns being withdrawn from two separate cross-wound supply packages for processing in a textile yarn processing machine.
Figure 2:
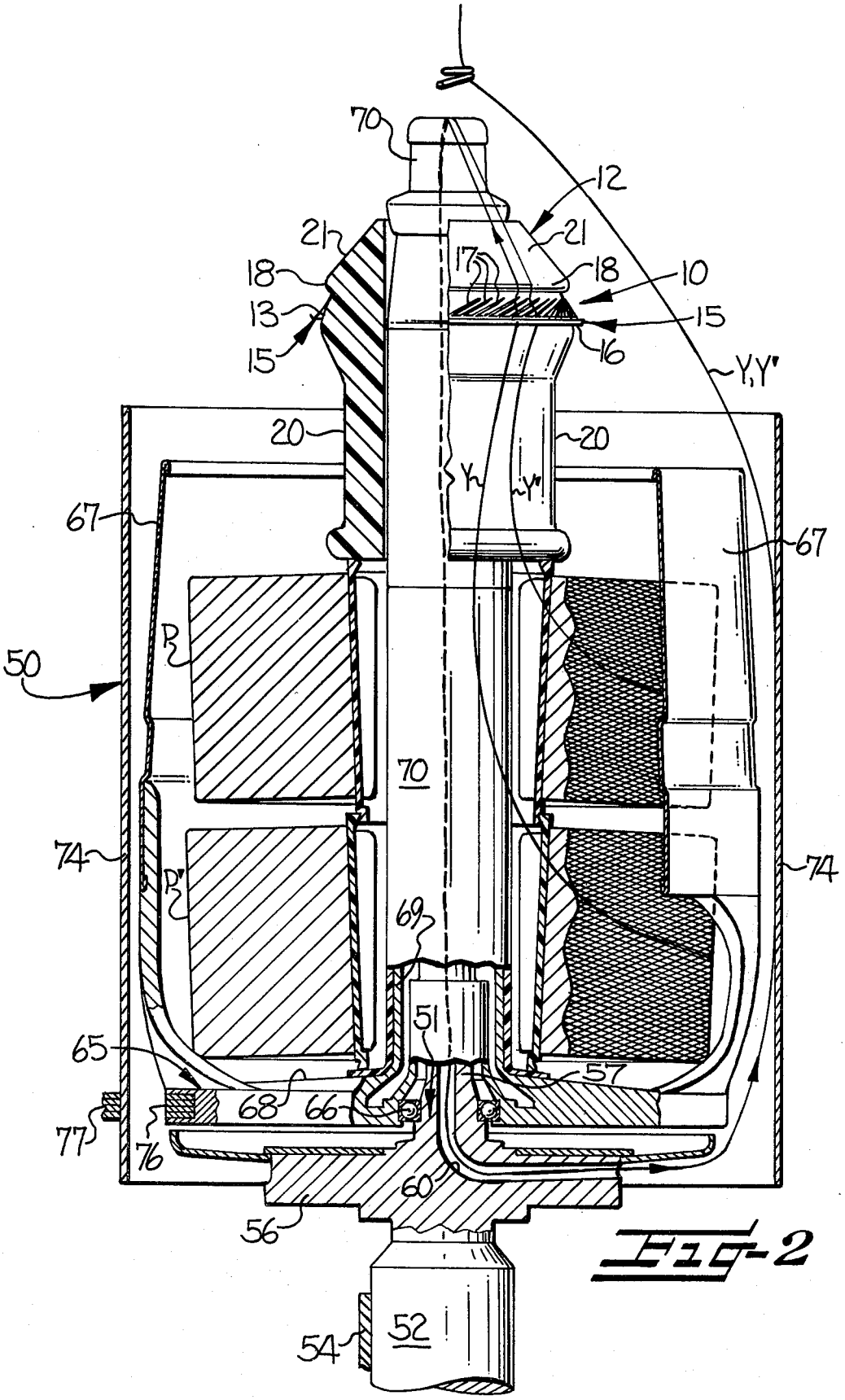
FIG. 2 is a sectional view through a portion of a spindle assembly of a two-for-one twister textile yarn processing machine utilizing the yarn brake mechanism of this invention for tensioning two yarns being withdrawn from separate cross-wound supply packages.

Referring now more particularly to the drawings, the yarn brake mechanism of this invention is generally indicated by the reference numeral 10. In FIG. 1, the yarn brake mechanism 10 is illustrated schematically therein for applying substantially uniform tension to at least two yarns Y, Y′ moving from separate cross-wound supply packages P, P′ for processing in any textile yarn processing machine. In FIG. 2, the yarn brake mechanism 10 is illustrated in its preferred environment of being mounted in a spindle assembly, generally indicated at 50, of a two-for-one twister textile yarn processing machine for applying substantially uniform tension to at least two yarns, Y, Y′ moving from separate cross-wound supply packages P, P′.

In both FIGS. 1 and 2, the yarns Y, Y′ are simultaneously withdrawn from the supply packages P, P′ in a common circumferential direction of movement, i.e. counterclockwise, due to the nature of cross-winding the yarn Y, Y′ on such supply packages P, P′ and the positioning of such supply packages P, P′ in the textile yarn processing machine. The yarns Y, Y′ are also withdrawn in a common linear direction of movement, from the supply packages P, P′, i.e. generally vertically upwardly, for processing in the textile yarn processing machine.

Figure 3:
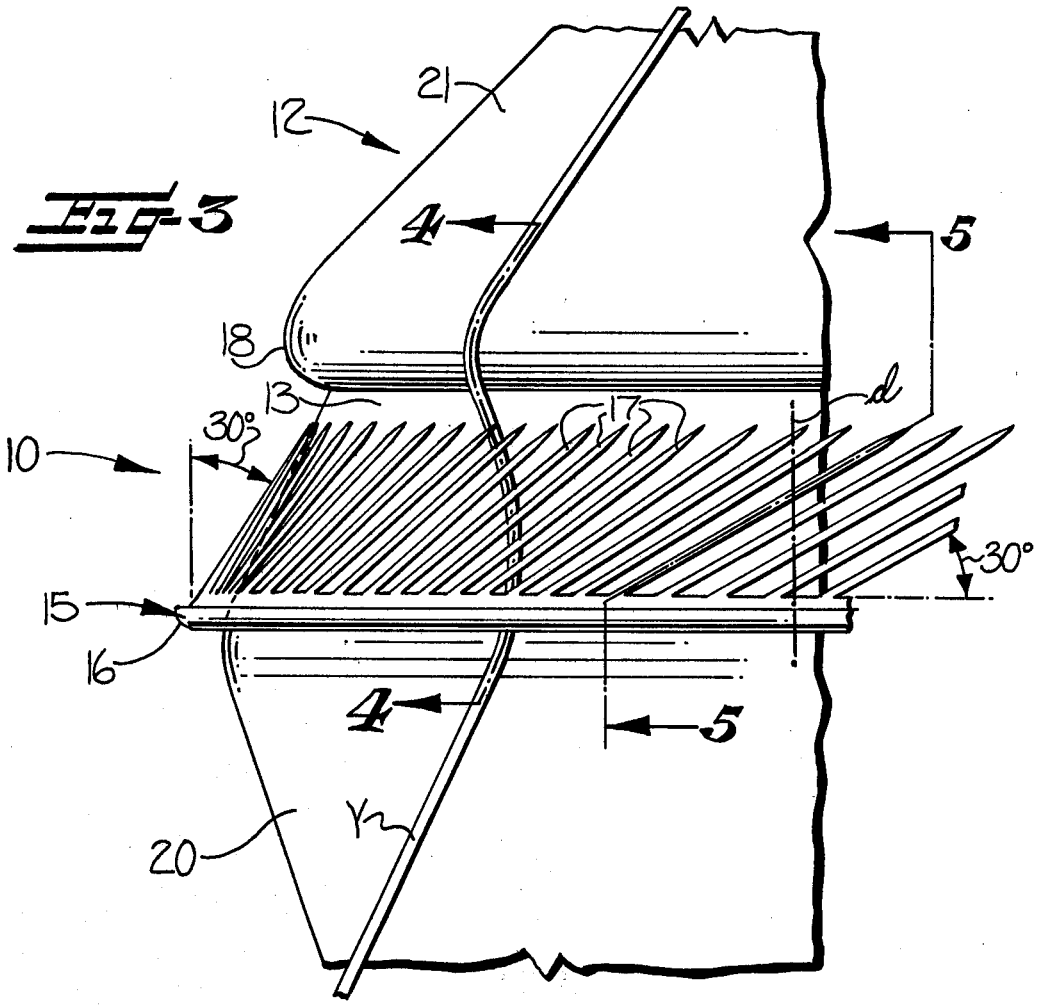
FIG. 3 is an enlarged partial elevational detail of the yarn brake mechanism of FIG. 1.
Figure 4:
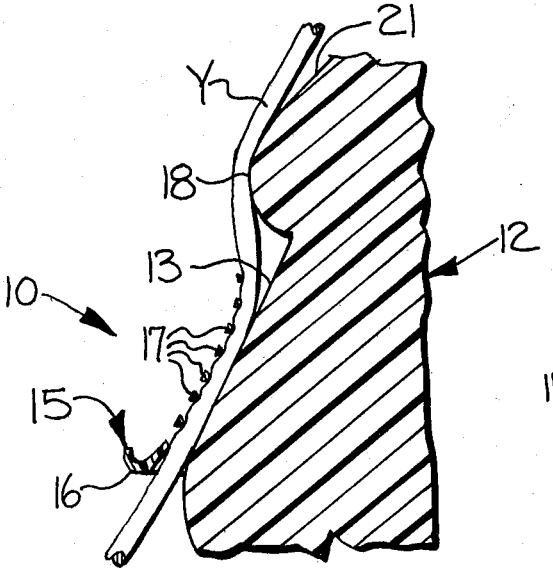
FIG. 4 is a sectional detail, taken generally along the line 4–4 of FIG. 3.
Figure 5:
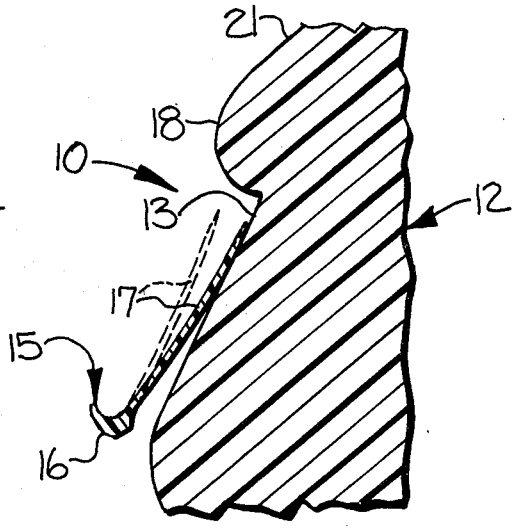
FIG. 5 is a sectional detail, taken generally along the line 5—5 of FIG. 3.

In both FIGS. 1 and 2, as well as the detail views of FIGS. 3–5, the yarn brake mechanism 10 of this invention comprises, generally the following.

A member 12 is mounted in the textile yarn processing machine and positioned generally in the linear path of movement of the yarns Y, Y′. The member 12 defines an outer, frusto-conical shaped, yarn braking surface 13 tapered in the linear direction of movement of the yarns Y, Y′, i.e. inwardly from the lower extent to the upper extent. A comb-like, braking ring member 15 is slidably positioned around the braking surface 13 of the member 12 and dimensioned for receiving the moving yarns Y, Y′ in braking engagement between the braking surface 13 and the ring member 15, i.e. the ring member 15 is slightly larger in diameter than the frusto-conical shaped braking surface 13 for allowing passage of the yarns Y, Y′ between the ring member 15 and the braking surface 13.

The ring member 15 includes a base ring portion 16 having slightly spaced-apart teeth 17 of pliantly elastic, springy material positioned therearound and extending therefrom generally in the linear direction of movement of the yarns Y, Y′, i.e. in an upward direction in the environments of FIGS. 1 and 2. The teeth 17 are inclined with respect to the ring portion 16, both inwardly into contact with the braking surface 13 and circumferentially in the circumferential direction of movement of the yarns Y, Y′, i.e. forming an angle of approximately 30 degrees with respect to a vertical axis extending from the periphery of the ring portion 16 and an angle of approximately 30 degrees with respect to a horizontal axis extending from the ring portion 16, as shown in FIG. 3. The degree of inward inclination of the teeth 17 is greater than the degree of inward inclination of the frusto-conical shaped braking surface 13 so that at least a portion of the teeth 17 will remain in contact with the braking surface 13, due in part to the pliantly elastic, springy material from which the teeth 17 are constructed, for purposes to be described more fully below. With this orientiation of the teeth 17, at least two of the teeth 17 overlap each other along each directrix d of the braking surface 13, as illustrated in FIG. 3, for purposes to be described more fully below.

Means, generally indicated at 18, are provided for limiting sliding movement of the braking ring member 15 along the braking surface 13 in the linear direction of movement of the yarns, i.e. in an upward direction in the environments of FIGS. 1 and 2. This means 18 may preferably comprise a radially outwardly projecting shoulder member extending from the braking surface 13 and having a rounded edge forming a cavetto, as illustrated particularly in FIGS. 3–5.

With the above construction of yarn brake mechanism 10, the ring member 15 may be easily slipped over the shoulder portion 18 of the member 12 and positioned around the braking surface 13. Due to the dimensions of the ring member 15, the ring member 15 will generally rest at the bottom of the frusto-conical shaped braking surface 13 of the member 12 and the teeth 17 will frictionally engage the braking surface 13 at all times, at least at their end portion or tips. The braking ring member 15 or a portion thereof may slide or float under the influence of the moving yarns Y, Y′ along the braking surface 13 to a limited extent until the tips of the teeth 17 engage the shoulder 18 on the member 12.

Thus, the two yarns Y, Y′ are positioned between the ring member 15 and the braking surface 13 on the member 12 and move therebetween during withdrawal from the supply packages, P, P′ for processing in the textile yarn processing machine. As the yarns Y, Y′ move upwardly and generally counter-clockwise around the member 12, each of the yarns Y, Y′ will always be engaged by two or more of the teeth 17 and the braking surface 13, regardless of the position of the individual yarns Y, Y′ or the position of the ring member 15 on the braking surface 13, to apply substantially uniform tension to each of the yarns Y, Y′. If one of the yarns Y or Y′ is under a greater tension than the other of the yarns Y or Y′ as they are being withdrawn from the supply packages P, P′, the brake ring 15 will move upwardly to a greater extent at the portion of engagement with that particular yarn Y or Y′. However, this will not affect tensioning of the other yarn Y or Y′ inasmuch as frictional braking engagement is always maintained with each of the yarns Y, Y′ by the braking ring member 15 and the braking surface 13 of the member 12.

The member 12 may also include outside surface portions 20, 21 of any desired configuration and the surface portion 21 may also be of generally frusto-conical shape extending from the shoulder 18 to provide a smooth guiding surface for the yarns Y, Y′ from the braking mechanism 10.

In the particular enivornment of a spindle assembly 50 of a two-for-one twister textile yarn processing machine, as partially illustrated in FIG. 2, the spindle assembly 50 includes a rotatably driven rotor mechanism, generally indicated at 51, which includes a whorl 52 suitably rotatably mounted on a portion of the twister frame (not shown) and rotated by a continuous tangential drive belt 54 in a manner well-understood by those with ordinary skill in the art. The rotor mechanism 51 further includes a horizontally-extending yarn reserve disc 56 secured to the whorl 52 for rotation therewith and a generally vertically-extending hollow axle 57 which also rotates with the reserve disc 56. The reserve disc 56 and hollow axle 57 define therewithin a generally L-shaped yarn passageway 60 extending generally vertically through the hollow axle 57 and a portion of the yarn reserve disc 56 and generally horizontally and radially out of the yarn reserve disc 56.

The spindle assembly 50 further includes a stationary yarn carrier mechanism, generally indicated at 65, for supporting and carrying the hollow supply packages P, P′ of yarn Y, Y′. The carrier mechanism 65 is mounted on the rotor mechanism 51 by bearings 66 so that the rotor mechanism 51 may rotate relative to the stationary yarn carrier mechanism 65. The yarn carrier mechanism 65 includes a basket device 67 which surrounds the yarn supply packages P, P′, a circular bottom portion 68 for supporting the yarn supply packages P, P′, and a hollow tubular hub portion 69 extending upwardly into the hollow yarn supply packages P, P′ for stabilizing the yarn supply packages P, P′. This tubular hub portion 29 also defines a generally vertically-extending yarn passageway therethrough, as indicated schematically by the path of the yarns Y, Y′ in FIG. 2, which communicates with the yarn passageway 60 through the rotor mechanism 51 to collectively provide a continuous yarn passageway extending through the spindle assembly 50. When processing two yarns Y, Y′ from two separate cross-wound supply packages P, P′, the spindle assembly 50 may include a hollow adapter 70 which is positioned on the stationary yarn carrier mechanism 65 and coaxially around the rotor mechanism 51 for receiving and carrying the two yarn supply packages P, P′ in superimposed, coaxial relationship with each other.

There is further provided a balloon limitor 74 surrounding the basket 67 so as to contain a balloon of the yarns Y, Y′ formed around the outside of the basket 67. In order to maintain the textile yarn package carrier mechanism 65, including the adapter member 70, stationary during rotation of the rotor mechanism 51, there are provided magnets 76 carried by the bottom portion 68 of the carrier mechanism 65 which cooperate with magnets 77 carried by the balloon limitor 74 to prevent rotation of the yarn carrier mechanism 65. There is also provided a processed yarn take-up mechanism (not shown) for taking up the yarn after being processed by the spindle assembly 50. Such take-up mechanisms are conventional in two-for-one twister spindle assemblies and an illustration thereof and further explanation is not believed necessary for a full understanding of this invention.

With the above-described mechanisms of the spindle assembly 50, the yarns Y, Y′ are simultaneously withdrawn from the supply packages P, P′ and are passed through the yarn brake mechanism 15 for uniform tensioning of each of the yarns Y, Y′ in the manner described above. The yarns Y, Y′ then pass into and through the collective yarn passageway in the yarn carrier mechanism 65, including the adapter 70, and the yarn passageway 60 through the rotor mechanism to emerge from the yarn reserve disc 56 in a generally horizontal direction. The yarns Y, Y′ then pass upwardly between the basket 67 and the balloon limitor 74 and form a rotating balloon of yarn which is contained by the balloon limitor 74. The yarns Y, Y′ then pass upwardly to the take-up mechanism (not shown) to complete their travel through the respective spindle assembly 50. As is well known by those with ordinary skill in the art, a two-for-one twist is inserted into the yarns Y, Y′ during the above-noted path of travel and the yarns Y, Y′ are twisted together.

With the yarn brake mechanism 15 of this invention, each of the yarns Y, Y′ receive a substantially uniform tension prior to entering into the yarn passageways through the spindle assembly and thus are uniformly processed by the two-for-one twister spindle assembly 50.

In the drawings and specification, there have been set forth preferred embodiments of the invention, and although specific terms are emloyed, they are used in a generic and descriptive sense only and not for purposes of limitation.

What is claimed is:

1. In a textile yarn processing machine including at least two, separate, cross-wound, supply packages of yarn, and means mounting said supply packages in said machine for simultaneous withdrawal of the yarns from said supply packages in a common circumferential direction of movement with respect to said supply packages and in a common linear direction of movement from said supply packages for processing in said machine; the combination therewith of a yarn brake mechanism for applying substantially uniform tension to the at least two yarns moving from said supply packages, said yarn brake mechanism comprising:

a member mounted in said machine and positioned in the linear path of movement of the at least two yarns and defining an outer, frusto-conical shaped, yarn braking surface tapered inwardly in the linear direction of movement of the yarns;

a comb-like, braking, ring member slidably positioned around said braking surface and dimensioned for receiving the at least two moving yarns in braking engagement between said braking surface and said ring member, said ring member having slightly spaced-apart teeth of pliantly elastic, springy material positioned therearound and extending therefrom generally in the linear direction of movement of the yarns, said teeth being inclined with respect to said ring both inwardly such that at least the tips of said teeth contact said braking surface and circumferentially in the circumferential direction of movement of the yarns, so that at least two of said teeth overlap each other along each directrix of said braking surface and frictionally engage each of the at least two yarns regardless of the position of the individual yarns or the position of said ring member on said braking surface; and means including an annular shoulder formed on said member at a location normally spaced from the tips of said teeth in the direction of yarn movement for limiting sliding movement of said braking ring member along said braking surface in the linear direction of movement of the yarns, and while permitting limited floating movement of said ring along the braking surface under the influence of the moving yarns and until said tips of said teeth engage said annular shoulder.

2. In a spindle assembly of a two-for-one twister textile yarn processing machine including a rotatable rotor mechanism defining a generally vertically and axially extending passageway therethrough for receiving moving yarns for processing, a stationary yarn carrier means mounted coaxially around said rotor mechanism and having a generally vertically and axially extending yarn passageway therethrough communicating with said yarn passageway through said rotor mechanism, and two, separate, cross-wound, supply packages of yarn carried by said carrier means is superimposed, coaxial relationship with each other for simultaneous withdrawal of the yarns from said supply packages in a common circumferential direction of movement with respect to said supply packages and in a generally vertically upward direction of movement from said supply packages to said yarn passageways for processing by said spindle assembly; the combination therewith of a yarn brake mechanism for applying substantially uniform tension to the two yarns moving from said supply packages to said yarn passageways, said yarn brake mechanism comprising:

a member mounted coaxially around said yarn carrier means and in superimposed position with respect to said supply packages of yarn and defining an outer, frusto-conical shaped, yarn braking surface tapered upwardly in the direction of movement of the two yarns;

a comb-like, braking, ring member positioned around said braking surface and dimensioned for receiving the two moving yarns in braking engagement between said braking surface and said ring member, said ring member having slightly spaced-apart teeth of pliantly elastic, springy material positioned therearound and extending therefrom generally upwardly in the direction of movement of the yarns, said teeth being inclined with respect to said ring both inwardly such that at least the tips of said teeth contact said braking surface and circumferentially in the circumferential direction of movement of the two yarns, so that at least two of said teeth overlap each other along each directrix of said braking surface and frictionally engage each of the at least two yarns regardless of the position of the individual yarns or the position of said ring member on said braking surface; and means including an annular shoulder formed on said member at a location normally spaced from the tips of said teeth in the direction of yarn movement for limiting sliding movement of said braking ring member upwardly along said braking surface in the direction of movement of the yarns, and while permitting limited floating movement of said ring along the braking surface under the influence of the moving yarns and until said tips of said teeth engage said annular shoulder.

3. The combination, as set forth in claim 1 or 2, in which the degree of inward inclination of said teeth of said ring member is greater than that of said braking surface to insure support of said ring member on said braking surface by at least the tips of said teeth.

4. The combination, as set forth in claims 1 or 2, in which said annular shoulder has a rounded edge forming a cavetto.

5. Process of applying substantially uniform tension to at least two yarns simultaneously moving in a textile yarn processing machine regardless of the individual initial tension on the two yarns, said process comprising the steps of:

simultaneously withdrawing at least two yarns from separate, cross-wound, supply packages in a common circumferential direction of movement with respect to the supply packages and in a common linear direction of movement from the supply packages;

providing a yarn brake mechanism in the linear path of movement of the at least two yarns being withdrawn from the separate supply packages and having a frusto-conical shaped, yarn braking surface tapered inwardly in the linear direction of movement of the yarns, a comb-like, braking, ring member slidably positioned around the braking surface and dimensioned for receiving the moving yarns in braking engagement between the braking surface and the ring member, the ring member having slightly spaced-apart teeth of pliantly elastic, springy material positioned therearound and extending therefrom in the linear direction of movement of the yarns, the teeth being inclined with respect to the ring both inwardly such that at least the tips of said teeth contact the braking surface and circumferentially in the circumferential direction of movement of the yarns so that at least two of the teeth overlap each other along each directrix of the braking surface, and an annular shoulder on said yarn braking surface at a location normally spaced from the tips of said teeth in the direction of yarn movement for limiting sliding movement of the braking ring along the braking surface in the linear direction of movement of the yarns, and while permitting limited floating movement of said ring along the braking surface and until said trips of said teeth engage said annular shoulder; and simultaneously passing the at least two yarns through the yarn brake mechanism and between the braking surface and the ring member allowing the ring member to move under the influence of the at least two yarns along the braking surface toward said annular shoulder, while frictionally engaging each of the at least two yarns independently by at least two of the teeth of the ring member and by the braking surface to apply uniform tension to each of the at least two yarns regardless of the position of any portion of the ring member on the braking surface.

* * * * *

UNITED STATES PATENT AND TRADEMARK OFFICE

CERTIFICATE OF CORRECTION

PATENT NO. : 4,434,609

DATED : March 6, 1984

INVENTOR(S) : Dieter Schacht

It is certified that error appears in the above-identified patent and that said Letters Patent is hereby corrected as shown below:

Column 1, Line 66, "actue" should be -- acute --.

Column 1, Line 68, after the words "tensioned with" insert -- the --.

Column 2, Line 52, delete "Nos.".

Column 5, Line 1, "enivornment" should be -- environment --.

Column 6, Line 23, "emloyed" should be -- employed --.

Column 8, Line 33, after the word "therefrom" insert the word -- generally --.

Column 8, Line 46, "trips" should be -- tips --.

Column 8, Line 51, after the word "influence" insert the words -- of each --.

Signed and Sealed this

*Twenty-second* Day of *May 1984*

[SEAL]

*Attest:*

GERALD J. MOSSINGHOFF

*Attesting Officer*

*Commissioner of Patents and Trademarks*